US008382240B2

(12) United States Patent
Katsuki et al.

(10) Patent No.: US 8,382,240 B2
(45) Date of Patent: Feb. 26, 2013

(54) LIQUID EJECTING APPARATUS

(75) Inventors: Kiyoteru Katsuki, Azumino (JP); Yoichi Yamada, Shiojiri (JP); Masaru Kobashi, Matsumoto (JP); Daisuke Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 78 days.

(21) Appl. No.: 12/944,091

(22) Filed: Nov. 11, 2010

(65) Prior Publication Data

US 2011/0115865 A1 May 19, 2011

(30) Foreign Application Priority Data

Nov. 19, 2009 (JP) ..... 2009-263655

(51) Int. Cl.
*B41J 2/165* (2006.01)
*B41J 2/01* (2006.01)

(52) U.S. Cl. ..... 347/34; 347/101; 347/104

(58) Field of Classification Search ..... 347/34
See application file for complete search history.

(56) References Cited

U.S. PATENT DOCUMENTS

| | | | | |
|---|---|---|---|---|
| 5,298,926 | A * | 3/1994 | Fukushima et al. | 347/34 |
| 5,751,308 | A * | 5/1998 | Gandy et al. | 347/33 |
| 5,896,148 | A * | 4/1999 | Fukushima et al. | 347/67 |
| 6,097,408 | A * | 8/2000 | Fukushima et al. | 347/34 |
| 6,152,445 | A * | 11/2000 | Hirota et al. | 271/315 |
| 6,802,591 | B2 * | 10/2004 | Takahashi | 347/36 |
| 2004/0207676 | A1 * | 10/2004 | Yamada et al. | 347/19 |
| 2006/0181589 | A1 * | 8/2006 | Nishida | 347/104 |
| 2007/0091146 | A1 * | 4/2007 | Endo et al. | 347/55 |
| 2009/0231387 | A1 * | 9/2009 | Shinkawa | 347/34 |
| 2010/0032891 | A1 * | 2/2010 | Togashi et al. | 271/18.1 |
| 2010/0165063 | A1 * | 7/2010 | Abramovitch | 347/101 |

FOREIGN PATENT DOCUMENTS

| | | | |
|---|---|---|---|
| JP | 2003-165230 | | 6/2003 |
| JP | 2003220695 | A * | 8/2003 |
| JP | 2007-118318 | | 5/2007 |
| JP | 2007-118320 | | 5/2007 |
| JP | 2007-118321 | | 5/2007 |
| JP | 2008-213255 | | 9/2008 |

* cited by examiner

*Primary Examiner* — Stephen Meier
*Assistant Examiner* — Leonard S Liang
(74) *Attorney, Agent, or Firm* — Workman Nydegger

(57) ABSTRACT

A liquid ejecting apparatus includes a liquid ejecting unit that ejects liquid onto a medium serving as an ejection target, a medium support unit that is disposed so as to face the liquid ejecting unit and supports the medium, a medium transportation unit that is first located at an upstream side of the liquid ejecting unit in a transportation direction of the medium and transports the medium to a downstream side, a medium contact section that makes contact with the medium between the medium transportation unit and the liquid ejecting unit in the transportation direction of the medium, and a same potential setting unit that sets the medium contact section and a predetermined section of the liquid ejecting unit to have the same potential.

6 Claims, 5 Drawing Sheets

LIQUID EJECTING APPARATUS

BACKGROUND

1. Technical Field

The present invention relates to a liquid ejecting apparatus typified by a fax machine and a printer.

2. Related Art

An ink jet printer is described below as an example of a liquid ejecting apparatus. The ink jet printer includes a support member (also called a platen) at a position facing an ink jet recording head. The support member supports a recording sheet so as to define a distance between the ink jet recording head and the recording sheet.

In recent ink jet printers, ink droplets have been reduced in size to further improve recording quality. For example, an ink droplet has been reduced in size to be about a few pico liters. Because of this reduction in size, the ink droplet has an extremely small mass. Some of such minute ink droplets do not land on the recording sheet and float as a mist after being ejected from the ink jet recording head toward the recording sheet, thereby causing various problems. Additionally, the floating mist phenomenon becomes much more pronounced in what is called borderless recording. Because, borderless recording is carried out on a recording sheet in such a manner that no margins remain at the four sides of the recording sheet, ink droplets are also ejected onto a region beyond the edges of the recording sheet.

In order to cope with such problems, a technique has been proposed in which a potential difference is provided among an ink jet recording head, a recording sheet, and a support member so as to generate an electric field, which exerts a Coulomb force on ink droplets to attract the ink droplets to the recording sheet. The technique is shown in JP-A-2007-118321 and JP-A-2007-118318, which are examples of related art.

1. Problems Associated with High-Speed Transportation of Recording Sheets

Recently, an ink jet printer has been proposed that can execute recording with an extremely high throughput by using a fixed ink jet recording head, i.e., what is called a line head, in which scanning (movement) is not carried out. In such an ink jet printer, the recording sheets are transported at an extremely high speed in a sheet transportation path inside thereof.

However, the following problems arise in association with such high-speed transportation of recording sheets. When the potential among the recording sheet, the support member (the platen), and the ink jet recording head (these three elements are collectively referred to as "recording section constituent elements" hereinafter) is not controlled, an electric field is generated among the recording section constituent elements. The electric field causes paper powder that is produced in cutting and sticks to the edges of the recording sheets to fly off toward the ink jet recording head and stick onto the ink jet recording head. Particularly, when the recording sheets are transported at a high speed, vibration and shock during the sheet transportation become large. As a result, flying off of the paper powder becomes much more pronounced.

Additionally, with increasing friction between the recording sheets housed in a sheet cassette, and sliding contact and contact between the constituent elements (e.g., an edge guide and a transportation roller) in the sheet transportation path and the recording sheets, frictional electrification and peeling electrification become much more pronounced. Consequently, the recording section constituent elements are more pronouncedly charged. An electric field generated among the recording section constituent elements becomes strong and the paper powder is also further charged. This increases a Coulomb force acting on the paper powder, so that the sticking of the paper powder to the ink jet recording head becomes much more pronounced.

Further, even if the paper powder is not charged, the paper powder flying off in the electric field is attracted to a side adjacent to the ink jet recording head, because electric charges are biased in the paper powder by dielectric polarization or static induction.

FIG. 5 is an explanatory view of the problem. In FIG. 5, an ink jet recording head 160, a nozzle plate 160*a*, a support member (a platen) 170, a rib 170*a* formed on the support member 170, a recording sheet P having a sheet edge section Pe, and paper powder d are shown. Circled plus signs and circled minus signs show the respective charged polarities.

The electric charges of the recording sheet P are eliminated by an anti-static brush or the like. Thus, the paper powder d stuck to the recording sheet P is not charged. However, when the nozzle plate 160*a* is positively charged and the support member 170 is negatively charged (as an example), negative electrical charges appear in the paper powder d at a side adjacent to the nozzle plate 160*a* while positive electrical charges appear at a side adjacent to the support member 170 due to dielectric polarization or static induction in the case shown in an enlarged view of a particle of the paper powder d. As the result, the paper powder d is attracted to both the nozzle plate 160*a* and the support member 170. Here, dielectric polarization occurs when paper powder d has characteristics of a dielectric material while static induction occurs when paper power d has characteristics of a conductor.

The paper powder stuck to the ink jet recording head directly blocks nozzle apertures or is moved to the nozzle apertures when a nozzle surface is cleaned (in wiping), thereby causing missing dots.

Besides the case where the paper powder physically blocks the nozzle apertures, a case may arise where a loading material, such as calcium carbonate, included in the paper powder reacts with water in ink to increase the viscosity of the loading material, thereby hindering meniscuses of the nozzle apertures from vibrating and ink droplets from being ejected as well. Consequently, preventing the paper powder from sticking to the ink jet recording head is very important to achieve appropriate recording quality in the ink jet printer.

2. Problems in Related Art

In JP-A-2007-118321 and JP-A-2007-118318, the technique is proposed in which a potential difference is provided among the ink jet recording head, the recording sheet, and the support member (the recording section constituent elements) so as to generate an electric field, which exerts a Coulomb force on ink droplets to attract the ink droplets to the recording sheet, as described above. With reference to the technique, it may be considered that the sticking of the paper powder to the ink jet recording head can be prevented by controlling an electric field so as to attract the paper powder to the recording sheet side if the paper powder is treated in the same way as the ink droplets.

However, the loading material and cellulose fibers that are included in the paper powder are easily charged with both a positive polarity and a negative polarity from the point view of triboelectric series. Accordingly, an attempt to prevent the paper powder from flying off toward the ink jet recording head by forming an electric field in a specific direction among the recording section constituent elements will fail, because this attempt cannot prevent the paper powder charged with the opposite polarity to that of the recording section constituent element from flying off toward the ink jet recording head.

JP-A-2003-165230 discloses a recording apparatus having an air duct that is provided around a nozzle plate and prevents paper powder, dust and the like from sticking around a nozzle section of an ink jet recording head as one of the objectives thereof. In the apparatus, humidified air is ejected from the air duct in a recording state and a recording waiting state. The structure, however, causes the apparatus to become larger and to increase costs due to the increased complexity of the structure. Additionally, airflow may promote sticking of the paper powder to the recording head.

JP-A-2008-213255 discloses a technique in which a paper powder collection member conductivity collects paper powder. This technique also has the problem of the opposite polarity described as above, so that the paper powder cannot be consistently and efficiently collected. Additionally, a problem arises regarding treatment (removal) of the paper powder deposited on the paper powder collection member. Particularly, in a state where much paper powder has been deposited, the paper powder may fly off into surrounding spaces due to a small vibration or shock. The technique, thus, has a problem of how to maintain the performance in the long term.

SUMMARY

An advantage of an aspect of the invention is that foreign materials including paper powder and dust (hereinafter, referred to as "paper powder and the like") are reliably prevented from sticking to an ink jet recording head.

A liquid ejecting apparatus according to an aspect of the invention includes a liquid ejecting unit that ejects liquid onto a medium serving as an ejection target, a medium support unit that is disposed so as to face the liquid ejecting unit and supports the medium, a medium transportation unit that is first located at an upstream side of the liquid ejecting unit in a transportation direction of the medium and transports the medium to a downstream side, a medium contact section that makes contact with the medium between the medium transportation unit and the liquid ejecting unit in the transportation direction of the medium, and a same potential setting unit that sets the medium contact section and a predetermined section of the liquid ejecting unit to have same potential.

According to the aspect of the invention, the medium contact section that makes contact with the medium serving as an ejection target, and the predetermined section of the liquid ejecting unit are set to have the same potential. Therefore, an extremely weak or almost non-existent electric field is formed between the medium and the liquid ejecting unit (hereinafter, such state is referred to as a no-electric-field state for the sake of convenience). In other words, a case does not occur in which an electric field is formed between the medium and the liquid ejecting unit, and the electric field exerts a Coulomb force on the paper powder and the like. Consequently, it is possible to prevent the paper powder and the like from flying off and sticking to the liquid ejecting unit.

Additionally, the medium contact section is provided at the downstream side of the medium transportation unit first located at the upstream side of the liquid ejecting unit. If a transportation unit that makes contact with the medium is provided at the downstream side of the medium contact section, the medium is charged by the transportation unit, so that a potential difference may be formed between the medium and the liquid ejecting unit. The aspect of the invention, however, can prevent the medium from being charged along the transportation path between the medium contact section and the liquid ejecting unit since the medium contact section is provided at the downstream side of the medium transportation unit first located at the upstream side of the liquid ejecting unit.

In the apparatus, the medium contact section may be provided so that the medium contact section does not make contact with the medium at least in an edge region of the medium.

Since the medium contact section is provided so that it does not make contact with the medium at least in the edge region of the medium, the medium contact section does not physically scrape the paper powder and the like stuck to the edges of the medium and cause them to fly in all directions.

In the apparatus, the medium contact section may be provided in a plurality in a direction perpendicular to the transportation direction of the medium so as to correspond to respective sizes of the medium supplied in a plurality of sizes.

Since the medium contact section is provided in a plurality in the direction perpendicular to the transportation direction of the medium so as to correspond to the respective sizes of the medium supplied in a plurality of sizes, the apparatus can correspond to mediums supplied in various sizes.

In the apparatus, the medium transportation unit may include a roller that makes contact with a first surface of the medium and rotates, the first surface facing the liquid ejecting unit, and the medium contact section may be provided to a cover member that covers an outer circumferential surface of the roller.

Since the medium transform unit includes the roller that makes contact with the first surface of the medium and rotates, and the medium contact section is provided to the cover member that covers the outer circumferential surface of the roller, the cover member can prevent the paper powder and the like from flying in all directions out of the roller to which the paper powder and the like easily stick. Additionally, since the medium contact section is provided to the cover member, the medium contact section can be disposed with a simple structure and low costs.

In the apparatus, the cover member may be provided so that the cover member is able to swing so as to be able to displace the medium contact section in a direction to come into contact with and out of contact with the medium, and may be also urged in such a direction that the medium contact section is elastically in contact with the medium.

Since the cover member is provided so that the cover member is able to swing so as to be able to displace the medium contact section in a direction to come into contact with and out of contact with the medium, and is also urged in such a direction that the medium contact section is elastically in contact with the medium, the medium contact section can freely accept the variations in the thickness and the posture of the medium so as to maintain contact with the medium.

In the apparatus, the same potential setting unit may set a predetermined section of the medium support unit to have the same potential in addition to the medium contact section and the predetermined section of the liquid ejecting unit.

Since the same potential setting unit sets the predetermined section of the medium support unit to have the same potential in addition to the medium contact section and the predetermined section of the liquid ejecting unit, almost no existent electric field is formed among the liquid ejecting unit, the medium, and the medium support unit in a liquid ejecting region in which liquid is ejected onto the medium. This makes it possible to reliably prevent the paper powder and like from flying toward and sticking to the liquid ejecting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
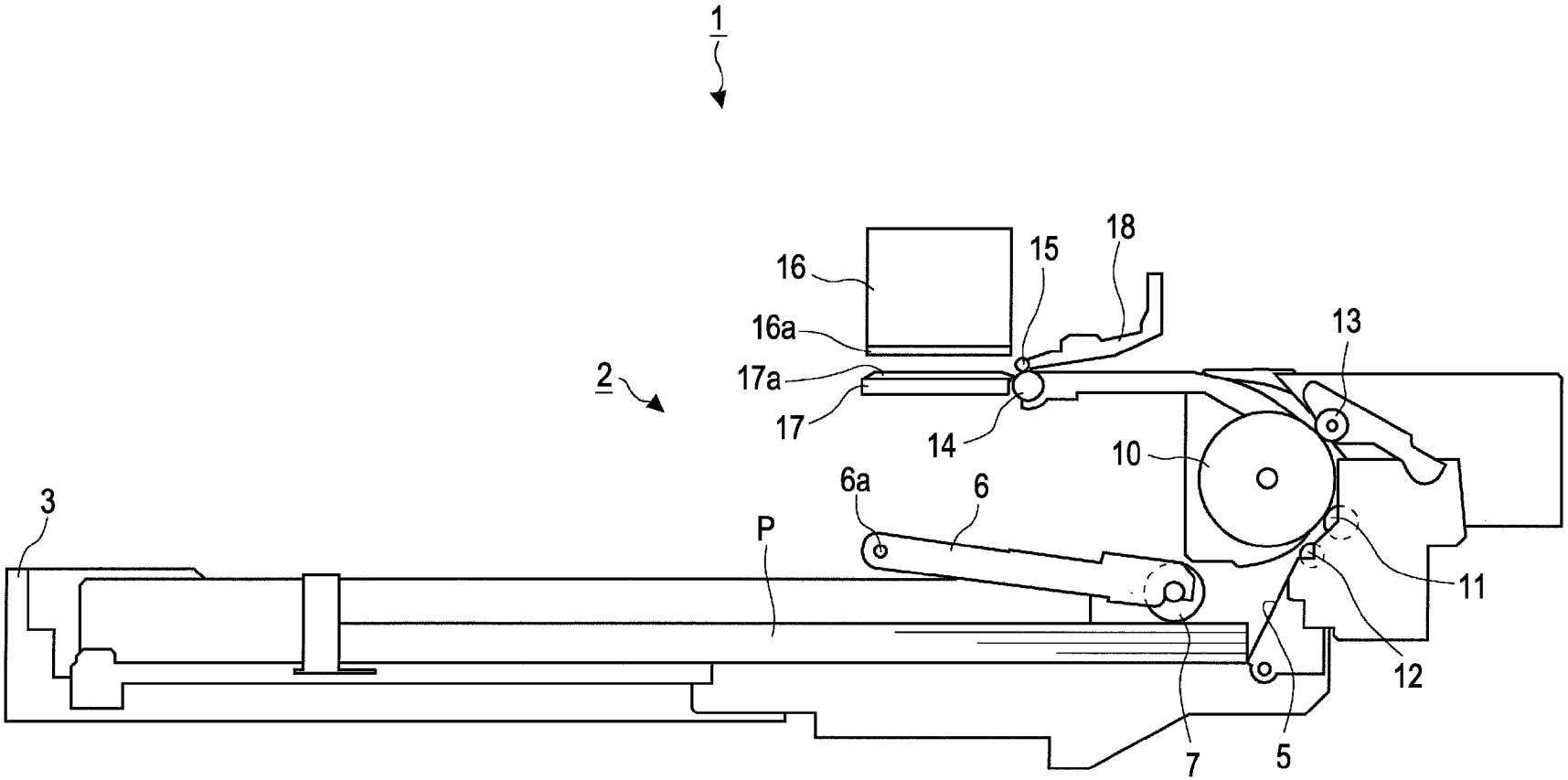
FIG. 1 is a schematic side sectional view showing a sheet transportation path of a printer according to an embodiment of the invention.
Figure 2:
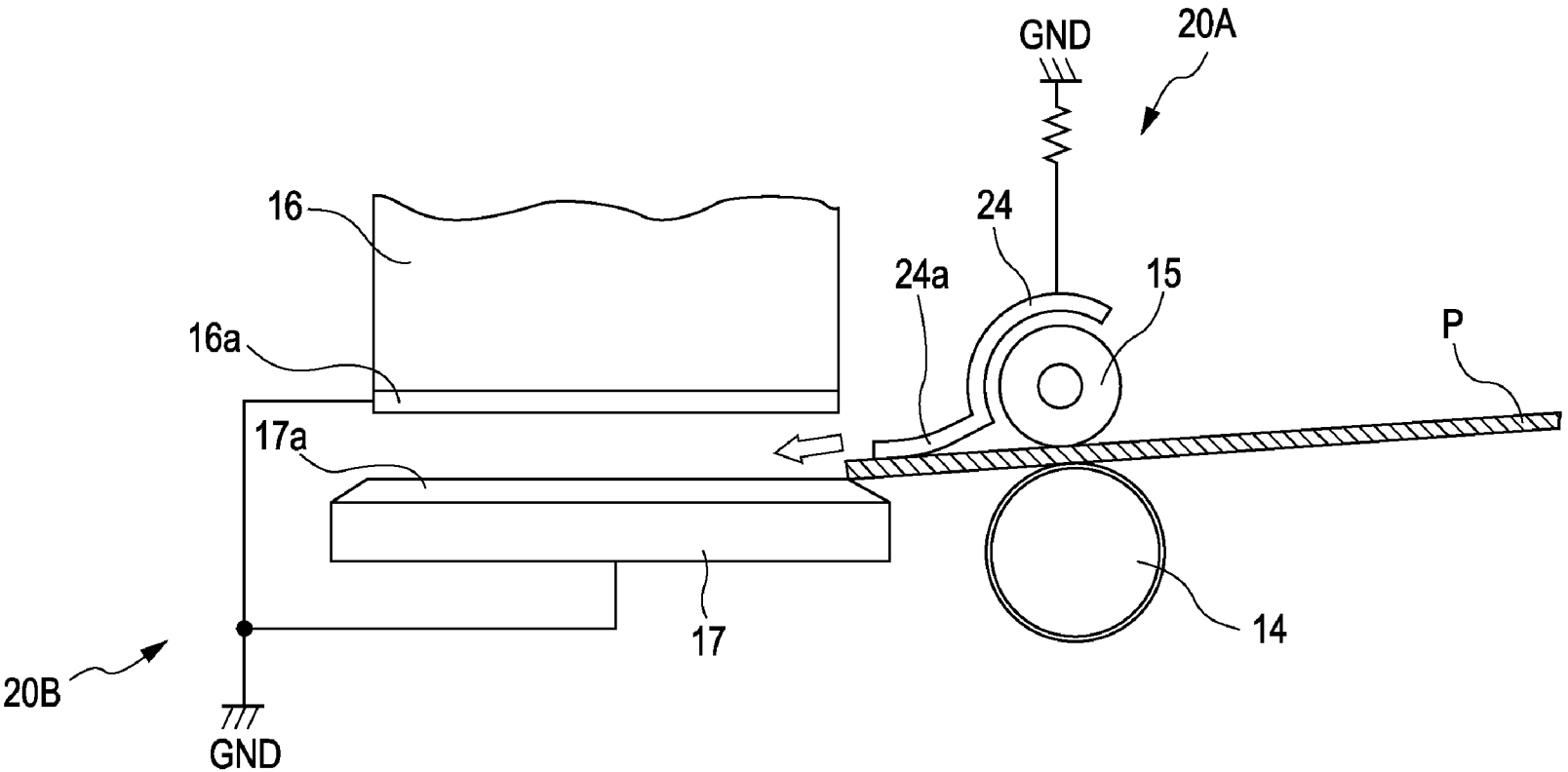
FIG. 2 is a side view of a recording execution region of the printer according to the embodiment of the invention.
Figure 3A:
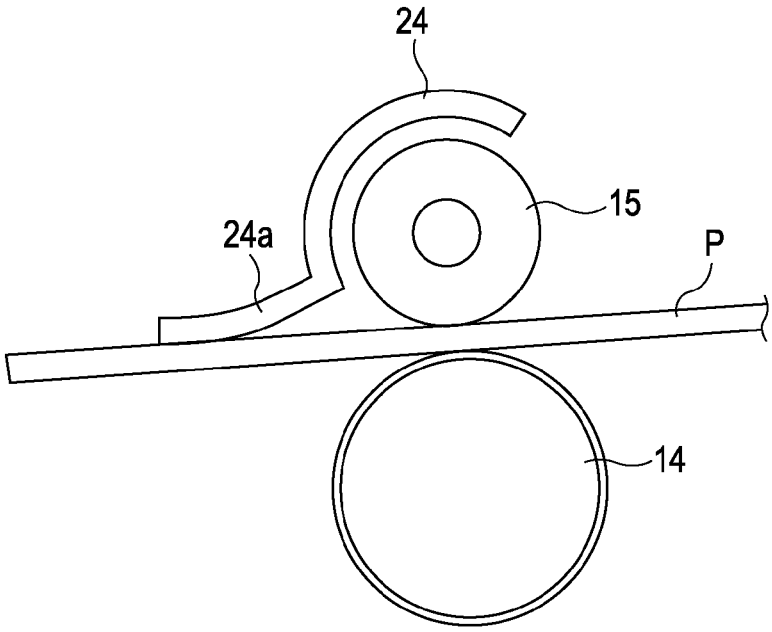
FIGS. 3A and 3B are enlarged views showing the shapes of a sheet contact section.
Figure 3B:
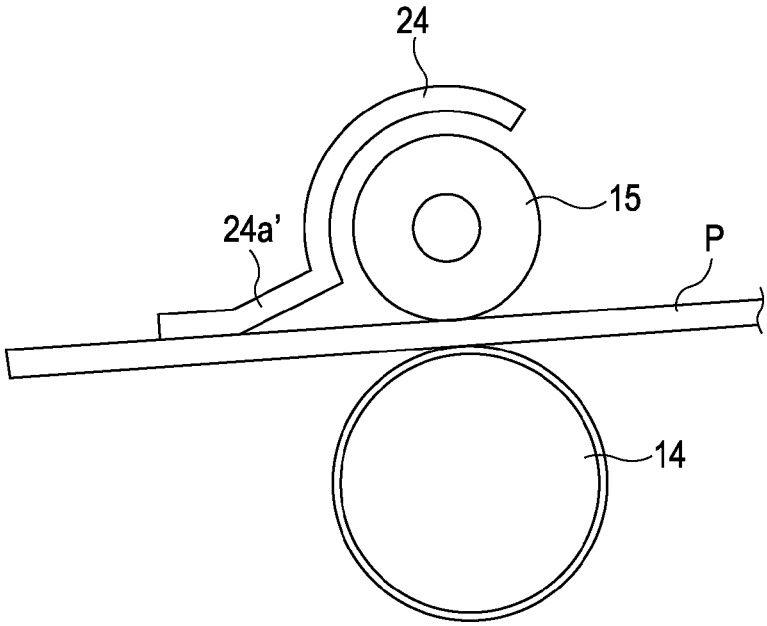
Figure 4:
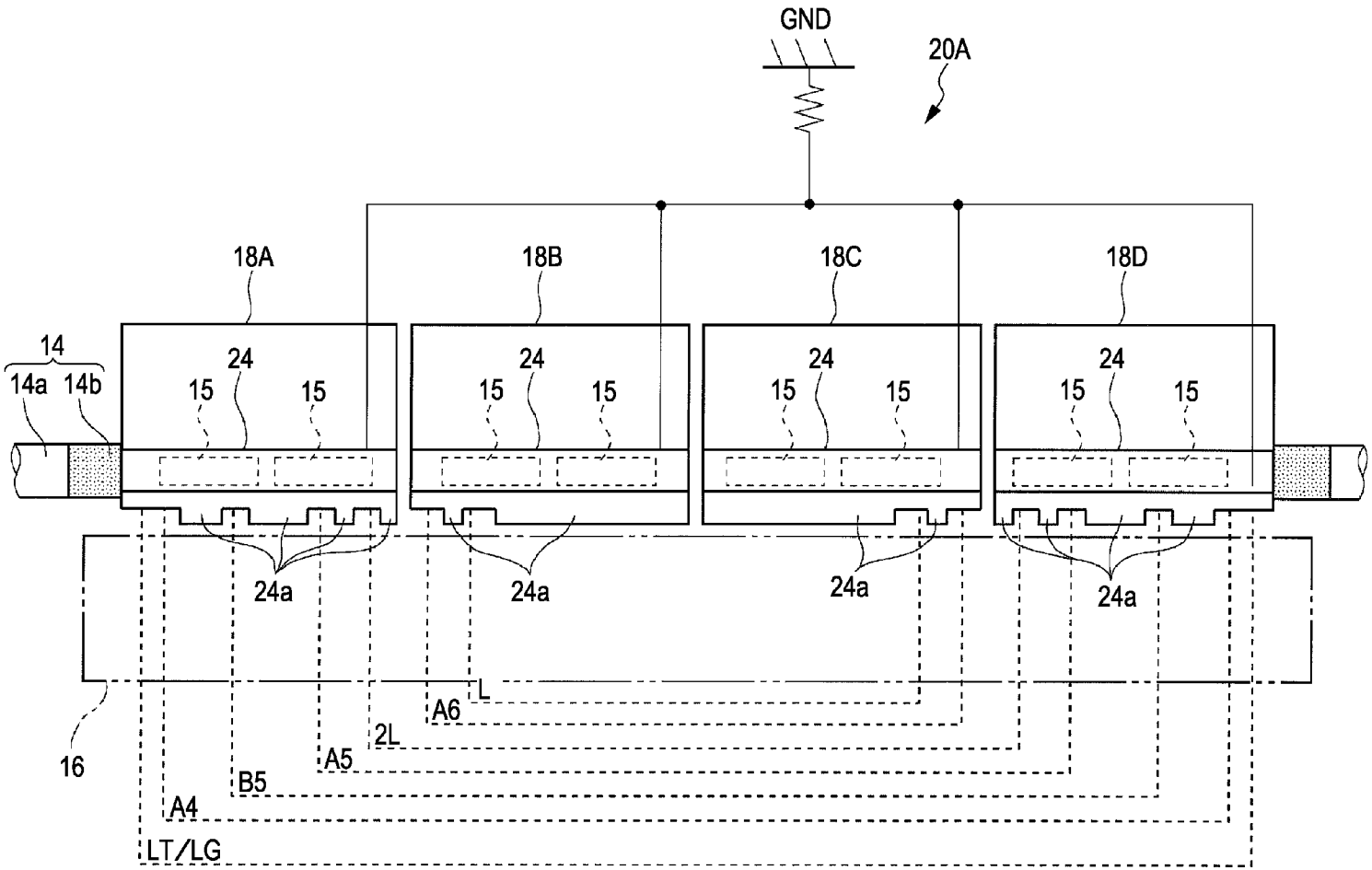
FIG. 4 is a plan view showing the recording execution region of the printer according to the embodiment of the invention.
Figure 5:
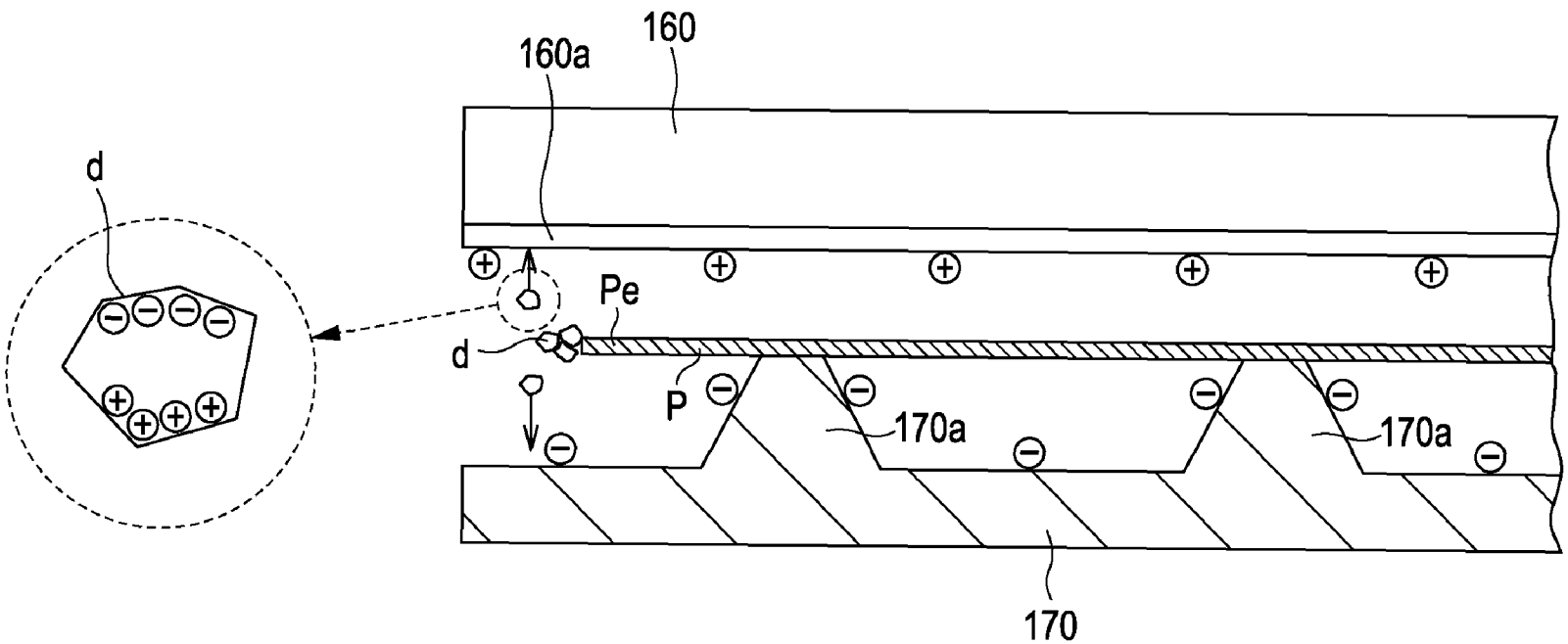
FIG. 5 (PRIOR ART)
FIG. 5 is an explanatory view to explain problems of the related art.

An embodiment of the invention is described with reference to the accompanying drawings below. FIG. 1 is a schematic side sectional view showing a sheet transportation path of an ink jet printer 1 according to the embodiment of the invention. FIG. 2 is a side view showing a recording execution region of the ink jet printer 1. FIGS. 3A and 3B are enlarged views showing the shapes of a sheet contact section 24*a*. FIG. 4 is a plan view showing the recording execution region of the ink jet printer 1.

The overall structure of the ink jet printer 1 is outlined with reference to FIG. 1, below. The ink jet printer 1 includes a sheet feeder 2 in the bottom section thereof. The sheet feeder 2 feeds forward a recording sheet P serving as an example of a medium serving as an ejection target. The recording sheet P is curved and reversed by an intermediate roller 10 so as to be fed toward an ink jet recording head 16 serving as a liquid ejecting unit and subjected to recording.

More specifically, the sheet feeder 2 includes a sheet cassette 3, a pick up roller 7, the intermediate roller 10, a retard roller 11, and guide rollers 12 and 13. A separation slope 5 is disposed at a position facing a leading end of the recording sheet P housed in the sheet cassette 3 that can be attached to and detached from the sheet feeder 2. The recording sheet P fed forward by the pick up roller 7 is fed to a downstream side while the leading end of the recording sheet P slides over the separation slope 5. This allows a preliminarily separated uppermost recording sheet P to be fed from the succeeding recording sheet P that tends to be fed along therewith by being led by the uppermost recording sheet P.

The pick up roller 7 included in a sheet feed unit is rotatably supported by a swing member 6 that can swing around a swing shaft 6*a* as a center in a clockwise direction and a counterclockwise direction in FIG. 1, and is also provided so that it is rotationally driven by the power of a drive motor (not shown). The pick up roller 7 makes contact with the uppermost recording sheet P housed in the sheet cassette 3 and rotates so as to feed forward the uppermost recording sheet P from the sheet cassette 3 in sheet feeding.

The recording sheet P fed from the sheet cassette 3, then, enters a curving and reversing zone. In the curving and reversing zone, the intermediate roller 10, the retard roller 11, and the guide rollers 12 and 13 are provided.

The intermediate roller 10 having a large diameter forms the inside of a curving and reversing path through which the recording sheet P is curved and reversed, and is rotationally driven by a drive motor (not shown). The intermediate roller 10 rotates in the counterclockwise direction in FIG. 1 so as to transport the recording sheet P to the downstream side while winding and feeding the recording sheet P around the intermediate roller 10.

The retard roller 11 is provided so that it can make contact with the intermediate roller 10 with a pressure while receiving predetermined rotational friction resistance, and also can move apart from the intermediate roller 10. The retard roller 11 nips the recording sheet P between itself and the intermediate roller 10 so as to separate the uppermost sheet P to be fed from the succeeding recording sheet P that tends to be fed along therewith by being led by the uppermost recoding sheet P.

Here, a sheet return lever (not shown) is provided in the sheet feed path in the vicinity of the retard roller 11. The sheet return lever returns, to the sheet cassette 3, the succeeding recording sheet P stopped moving forward by the retard roller 11.

The guide rollers 12 and 13 can freely rotate. The guide roller 13 nips the recording sheet P between itself and the intermediate roller 10 so as to assist the intermediate roller 10 to feed the recording sheet P.

The sheet feeder 2 is structured as described above. The ink jet printer 1 including the sheet feeder 2 further includes, at the downstream side of the intermediate roller 10, a sheet transportation unit including a transportation drive roller 14 and a transportation driven roller 15. The transportation drive roller 14 is rotationally driven by a drive motor (not shown) while the transportation driven roller 15 nips the recording sheet P between itself and the transportation drive roller 14 so as to be rotated by the transportation of the recording sheet P.

Here, an upper guide member 18 supports the transportation driven roller 15 in such a manner that the transportation driven roller 15 can freely rotate, and is provided in a plurality along an axial line direction of the transportation drive roller 14 in the embodiment (refer to FIG. 4). In the embodiment, each upper guide member 18 rotatably supports two transportation driven rollers 15. Further, in the embodiment, the transportation drive roller 14 is a metal shaft and has abrasion-resistant particles stuck to the surface of the metal shaft so as to increase a frictional force between the surface and the recording sheet P. In FIG. 4, no abrasion-resistant particles are stuck to a metal surface 14*a* while the abrasion-resistant particles are stuck to a high friction surface 14*b*.

Referring back to FIG. 1, a downstream side region of the transportation drive roller 14 is a recording region in which recording is executed on the recording sheet P. In the down stream side region, the ink jet recording head 16 serving as the liquid ejecting unit and a support member 17 that defines the distance between the recording sheet P and the ink jet recording head 16 by supporting the recording sheet P are disposed to face each other.

In the ink jet recording head 16, a nozzle plate 16*a* made of metal has a plurality of ink ejecting nozzles (not shown) formed therein, and forms a first side facing the support member 17. A rib 17*a* formed on the support member 17 extends in a sheet transportation direction (a first direction: the left-right direction in FIG. 1) and is formed in a plurality in a sheet width direction (a second direction: the front-back direction of the drawing) with appropriate intervals. The ribs 17*a* support the recording sheet P.

In the embodiment, the ink jet recording head 16 is what is called a line head having such a length as to cover the width of the sheet. Recording can be executed by simply moving the recording sheet P in the sheet transportation direction (the first direction) without reciprocating the ink jet recording head 16 in the sheet width direction (the second direction). The head, however, is not limited to this type. A head of a serial type can be employed that executes recording while moving in the sheet width direction.

The recording sheet P is subjected to recording between the ink jet recording head 16 and the support member 17 (in the recording region), and discharged to outside the apparatus by a discharge unit (not shown in FIG. 1).

The overall structure of the ink jet printer 1 is described above. A distinctive structure of the recording region is described below with reference to FIGS. 2 to 4. In FIGS. 2 and 4, a cover 24 covers an outer circumferential surface of the transportation driven roller 15. The cover 24 is provided in the upper guide member 18 (upper guide members 18A to 18D shown in FIG. 4) rotatably supporting the transportation driven rollers 15.

As shown in FIG. 2, the cover 24 is formed so as to cover the outer circumferential surface, particularly the outer circumferential surface at a side adjacent to the ink jet recording head 16, of the transportation driven roller 15. As shown in FIG. 4, the cover 24 has such a width as to be capable of covering two transportation driven rollers 15 in each upper guide member 18.

The cover 24 does not make contact with the outer circumferential surface of the transportation driven roller 15, and has a sheet contact section 24*a* having a flange shape at the downstream side (the left side in FIG. 2) in the sheet transportation path. The sheet contact section 24*a* has conductivity, and is provided so as to make contact with a first surface (a front surface facing the ink jet recording head 16) of the recording sheet P.

The sheet contact section 24*a* preferably makes contact with the first surface of the recording sheet P without any damage thereto. The sheet contact section 24*a* is, thus, preferably formed so as to make contact with the recording sheet P with a curved surface as shown in FIG. 3A or so as to make contact with the recording sheet P with a flat surface as shown in FIG. 3B.

The sheet contact section 24*a* is disposed in a region outside of an edge region including the sheet edges so as not to make contact with the first surface of the recording sheet P in the edge region (refer to FIG. 4). While the sheet contact section 24*a* and the cover 24 are integrally formed as described above in the embodiment, the structure is not limited to this. The sheet contact section 24*a* may be individually formed and fixed to the cover 24. Alternatively, the sheet contact section 24*a* may be provided in another constituent element instead of being provided in the cover 24.

In the embodiment, as shown in FIG. 4, the sheet contact section 24*a* is provided in a plurality so as to correspond to each size of the recording sheet P supplied in different sizes for managing the respective sizes. In FIG. 4, rectangular shapes indicating with broken lines together with sheet size indicators such as "LT/LG", "A4", and "B5" show the respective recording sheets having different sizes. In FIG. 4, additional characters (A to D) are given to the upper guide members 18 provided in the sheet width direction in order to distinguish the upper guide members 18 from one to another based on the differences in the arrangement positions.

The cover 24 is provided so that it can swing around the rotational center of the transportation driven roller 15 (in the clockwise direction and the counterclockwise direction in FIG. 2) so as to be able to displace the sheet contact section 24*a* in a direction to come into contact with and out of contact with the recording sheet P. The cover 24 is also provided so that it is urged by an urging unit (not shown) in such a direction that the sheet contact section 24*a* is elastically in contact with the recording sheet P.

Same potential setters 20A and 20B are shown in FIG. 2. The same potential setters 20A and 20B set the sheet contact section 24*a*, the nozzle plate 16*a*, and the support member 17 to have the same potential in the embodiment.

More specifically, the sheet contact section 24*a* (the cover 24) and the support member 17 are resin parts formed with a resin material in which conductive materials, such as metal and carbon, are mixed so as to have conductivity, for example, with a surface resistivity of about $10^2$ to $10^8$ Ω/square. The cover 24 (the sheet contact section 24*a*) is earthed through a grounding resistor. Therefore, the potential of the recording sheet P making contact with the sheet contact section 24*a* becomes the earth (zero) potential.

The nozzle plate 16*a* and the support member 17 are also earthed. Consequently, the recording sheet P, the nozzle plate 16*a*, and the support member 17 have the same potential, thereby resulting in a state in which no electric field is formed (a no-electric-field state) among them being formed.

Since the ink jet printer 1 is structured as described above, the recording region of the ink jet printer 1 demonstrates the following operations and effects. The same potential setters 20A and 20B set the recording sheet P, the nozzle plate 16*a*, and the support member 17 to have the same potential, resulting in a state in which no electric field is formed (a no-electric-field state) among them being formed. In other words, there is no case where an electric field is formed and the electric field exerts a Coulomb force on paper powder and the like. This makes it possible to reliably prevent the paper powder and the like from flying toward and sticking to the nozzle plate 16*a*.

Additionally, the sheet contact section 24*a* is provided at the downstream side of the transportation drive roller 14 and the transportation driven roller 15 that serve as the sheet transportation unit first located at the upstream side of the ink jet recording head 16. In contrast, if a transportation unit making contact with the recording sheet P is provided at the downstream side of the sheet contact section 24*a*, the recording sheet P may be charged by the transportation unit, thereby forming a potential difference between the recording sheet P and the nozzle plate 16*a*.

However, in fact, the sheet contact section 24*a* is provided at the downstream side of the transportation drive roller 14 and the transportation driven roller 15 that serve as the sheet transportation unit first located at the upstream side of the ink jet recording head 16. More specifically, the sheet contact section 24*a* is provided in the vicinity of the upstream side of the ink jet recording head 16. This can prevent the recording sheet P from being charged along the transportation path between the sheet contact section 24*a* and the ink jet recoding head 16.

The sheet contact section 24*a* is provided so that it does not make contact with the recording sheet P at least in the edge region of the first surface of the recording sheet P as shown in FIG. 4. This prevents the sheet contact section 24*a* from physically scraping the paper powder and the like stuck to the edges of the recording sheet P and causing them to fly in all directions.

Further, since the sheet contact section 24*a* is provided in the cover 24 covering the outer circumferential surface of the transportation driven roller 15, the cover 24 can prevent the paper powder and like from flying in all directions out of the transportation driven roller 15 to which the paper powder and the like easily stick. Providing the sheet contact section 24*a* to the cover 24 allows the sheet contact section 24*a* to be disposed with a simple structure and low costs.

Furthermore, the cover 24 is provided so that it can swing (in the clockwise direction and the counterclockwise direction in FIG. 2) so as to be able to displace the sheet contact section 24*a* in a direction to come into contact with and out of contact with the recording sheet P. The cover 24 is also urged in such a direction that the sheet contact section 24*a* is elastically in contact with the recording sheet P. As a result, the sheet contact section 24*a* can freely accept the variations in the thickness and the posture of the recording sheet P so as to be able to maintain the contact with the recording sheet P.

Modified examples of the embodiment

1. Same Potential Setting Unit

In the embodiment, the same potential setters 20A and 20B set the sheet contact section 24*a*, the nozzle plate 16*a*, and the support member 17 to have the same potential. All of them, however, are not necessarily set to have the same potential. For example, setting only the sheet contact section 24*a* and the nozzle plate 16*a* to have the same potential is effective for preventing the paper powder from flying off because no electric field is formed between the recording sheet P and the nozzle plate 16*a*.

When the respective constituent elements are set to have the same potential, the setting method is not limited to earthing. Any voltage having any polarity may be applied to set the same potential. That is, as long as any two of the constituent elements are set to have the same potential, this makes it effective for preventing the paper powder from flying in all directions because no electric field is formed between the two elements.

2. Nozzle Plate

The nozzle plate 16*a* of the embodiment can be provided with a water repellent film on its surface. The use of a water repellent film having conductivity can prevent the water repellent film from being charged, enabling the paper powder and the like to be prevented from sticking to the nozzle plate 16*a*, and the potential of the nozzle plate side to be reliably controlled.

The use of a water repellent film having insulation properties can reduce an image force of the nozzle plate 16*a* made of metal, such as stainless steel, enabling the paper powder and the like that are stirred up around the nozzle plate 16*a* to be prevented from being attracted to the nozzle plate 16*a*. Here, the image force causes a phenomenon in which when the paper powder and the like having electrical charges approach the nozzle plate, electrical charges having the opposite polarity to that of the approaching ones appear in the nozzle plate, and the electrical charges having different polarities attract each other.

In the ink jet recoding head 16, a predetermined section to which a predetermined potential is applied or from which static charges are eliminated (i.e., the potential is controlled) is preferably the nozzle plate 16*a*, which is located at a side most adjacent to the support member 17 in the ink jet recording head 16. More specifically, a nozzle surface facing the support member 17 is preferable. Accordingly, the potential of the nozzle surface most adjacent to the recording sheet P is controlled, enabling an electric field to be prevented from entering from the surroundings, and the paper powder and the like to be effectively prevented from sticking to the nozzle surface. The same manner is applied to the support member 17. If the potential of a predetermined section of the support member 17 is controlled, the predetermined section is preferably a surface facing the nozzle plate 16*a*.

3. Applying Electrical Charges to Ink Droplets

When a predetermined potential is applied to the nozzle plate 16*a*, ink droplets are charged with induced electrical charges through the nozzle plate 16*a*. Electrical charges may be applied to ink droplets at any location in an ink flow path from an ink reservoir storing ink (e.g., an ink cartridge) to the nozzle plate 16*a*. For example, a part or the whole of an inside wall of the ink reservoir may be structured with a conductive member, and electrical charges may be applied to ink through the inside wall.

Applying the same potential as that of the sheet contact section 24*a* to liquid ink can tremendously weaken an electric field between the ink jet recording head 16 and the recording sheet P or the support member 17, thereby enabling a countermeasure for preventing the paper powder from sticking to the nozzle plate 16*a* to be taken. Meanwhile, the nozzle plate 16*a* can be made of not only a conductor such as metal, but also, for example, a dielectric material, such as silicon, acrylic, or polyimide. In this case, an electric field caused by a potential difference between ink inside the head and the recording sheet P or the support member 17 may exert strong influence on the paper powder, causing the paper powder to fly off toward the nozzle plate 16*a*. However, such problem can be eliminated by applying the same potential as that of the recording sheet P or that of the support member 17 to ink inside the head.

When the nozzle plate 16*a* is made of a dielectric material, a structure applying potential to ink inside the head can be employed as follows: only an ink flow path section in the nozzle plate (i.e., a section making contact with ink) is structured with a conductive member, and a potential is applied to ink through the conductive member. For example, when the nozzle plate has a multilayered structure, the ink flow path section may be structured with the conductive member in all layers or in at least one layer.

What is claimed is:

1. A liquid ejecting apparatus, comprising:

a liquid ejecting unit that ejects liquid onto a medium serving as an ejection target;

a medium support unit that is opposed to the liquid ejecting unit and supports the medium;

a medium transportation unit that is located at an upstream side of the liquid ejecting unit in a transportation direction of the medium and transports the medium to a downstream side;

a medium contact section that makes contact with the medium between the medium transportation unit and the liquid ejecting unit in the transportation direction of the medium; and a same potential setting unit that sets the medium contact section and a predetermined section of the liquid ejecting unit to have same potential.

2. The liquid ejecting apparatus according to claim 1, wherein the medium contact section is provided so that the medium contact section does not make contact with the medium at least in an edge region of the medium in the transport direction.

3. The liquid ejecting apparatus according to claim 1, wherein the medium contact section is provided in a plurality of numbers in a direction perpendicular to the transportation direction of the medium so as to correspond to respective sizes of the medium supplied in a plurality of sizes.

4. The liquid ejecting apparatus according to claim 1, wherein the medium transportation unit includes a roller that makes contact with a first surface of the medium and rotates, the first surface facing the liquid ejecting unit, and the medium contact section is provided to a cover member that covers an outer circumferential surface of the roller.

5. The liquid ejecting apparatus according to claim 4, wherein the cover member is provided so that the cover member is able to swing so as to be able to displace the medium contact section in a direction to come into contact with and out of contact with the medium, and is also urged in such a direction that the medium contact section is elastically in contact with the medium.

6. The liquid ejecting apparatus according to claim 1, wherein the same potential setting unit sets a predetermined section of the medium support unit to have the same potential in addition to the medium contact section and the predetermined section of the liquid ejecting unit.

* * * * *